US006618015B2

(12) United States Patent
Horibe

(10) Patent No.: US 6,618,015 B2
(45) Date of Patent: Sep. 9, 2003

(54) ANTENNA FOR USE WITH RADIO DEVICE

(75) Inventor: Akio Horibe, Chuo-ku (JP)

(73) Assignee: Uniden Corporation, Tokyo (JP)

( * ) Notice: Subject to any disclaimer, the term of this patent is extended or adjusted under 35 U.S.C. 154(b) by 0 days.

(21) Appl. No.: 10/021,001

(22) Filed: Dec. 19, 2001

(65) Prior Publication Data

US 2003/0058172 A1 Mar. 27, 2003

(30) Foreign Application Priority Data

Sep. 25, 2001 (JP) ..... 2001-292162

(51) Int. Cl.[7] ..... H01Q 1/24
(52) U.S. Cl. ..... 343/702; 343/700 MS
(58) Field of Search ..... 343/700 MS, 702, 343/873, 846; H01Q 1/24

(56) References Cited

U.S. PATENT DOCUMENTS

| | | | | |
|---|---|---|---|---|
| 5,233,360 A | * | 8/1993 | Kuroda et al. | 343/700 MS |
| 6,061,024 A | * | 5/2000 | McGirr et al. | 343/700 MS |
| 6,295,030 B1 | * | 9/2001 | Kozakai et al. | 343/700 MS |

FOREIGN PATENT DOCUMENTS

| | | |
|---|---|---|
| JP | A 54-139359 | 10/1979 |
| JP | A 54-139360 | 10/1979 |
| JP | U 3-16713 | 2/1991 |
| JP | A 4-354429 | 12/1992 |
| JP | A 5-37416 | 2/1993 |
| JP | U 6-4854 | 1/1994 |
| JP | A 7-66620 | 3/1995 |
| JP | A 9-83232 | 3/1997 |
| JP | A 9-266406 | 10/1997 |
| JP | A 9-321521 | 12/1997 |
| JP | A 9-321529 | 12/1997 |
| JP | A 2000-216612 | 8/2000 |

* cited by examiner

*Primary Examiner*—Hoanganh Le
(74) *Attorney, Agent, or Firm*—Oliff & Berridge, PLC

(57) ABSTRACT

The present invention provides an antenna for a radio device that has sufficient mounting strength with little deterioration in antenna property. A first antenna 1*a* and a second antenna 1*b* are provided substantially parallel to each other at both ends of a circuit board 3. Feeding points 2*a*, 2*b* are provided at one end of first antenna 1*a* and second antenna 1*b*, and are fed in equiphase. As radio-frequency currents 100*a*, 100*b* are in equiphase, vertically polarization are radiated, but horizontal radio-frequency currents 101*a*, 101*b* are in antiphase, so horizontally polarization are not radiated. Furthermore, antennas 1*a*, 1*b* may be formed by the mounting portions of the circuit board on the housing.

7 Claims, 6 Drawing Sheets

HORIZONTAL PATTERN

VERTICAL PATTERN

HORIZONTAL PATTERN

VERTICAL PATTERN

ANTENNA FOR USE WITH RADIO DEVICE

BACKGROUND OF THE INVENTION

1. Field of the Invention

The present invention relates to an antenna, incorporated in a radio device, that has a radiated element preferred for mobile radio devices, portable telephones, portable information terminals, etc.

2. Description of the Related Art

Recently, there are demands for even lighter, more compact, and thus handier, portable telephones, etc. This, at the same time, requires lighter and more compact antennas used for these devices.

When realizing a compact frame for portable telephones, etc., the printed board inside the device should desirably be held as small as possible. However, the portion used to mount the printed board onto the frame is necessary. In order to ensure that the mount portion has a predetermined mechanical strength, no components can be mounted onto the portion where the printed board and frame are in contact. This portion is mostly left as dead space on the printed board.

Also, incorporating the antenna into the device conventionally required a large number of components. For example, Patent Laid-Open Hei 9(1997)-321529 Publication discloses many components in FIG. 1: a printed board, an incorporated antenna (1), components (5,6) for connecting the antenna with the board, and additional supporting structures. Not only do these components take up large space inside the housing—they also require additional manufacturing steps and create non-uniform property due to contact failure and component irregularities.

Furthermore, conventional incorporated antennas had insufficient property due to changing directivity according to the shape of the printed board and the mounted position of the antenna.

The present invention aims at solving the above problems by providing an antenna for a radio device that efficiently uses the space inside the device, ensures sufficient mechanical strength, and can be made compact without entailing deterioration in property. This results in making the whole radio device more compact.

SUMMARY OF THE INVENTION

The antenna for a radio device according to the present invention includes a circuit board arranged within the radio device body; a first radiating element and a second radiating element arranged in axial symmetry to each other on said circuit board; and a feeding point for feeding each of said first radiating element and said second radiating element in equiphase, wherein said first radiating element and said second radiating element are respectively provided at the ends of said circuit board, and the feeding points of said first radiating element and said second radiating element are respectively provided in the vicinity of the corners of said circuit board.

This structure permits the antenna to be arranged in the vicinity of the transmitting/receiving and other circuits without incurring deterioration in antenna property.

DESCRIPTION OF THE PREFERRED EMBODIMENTS

Embodiment 1

Figure 1:
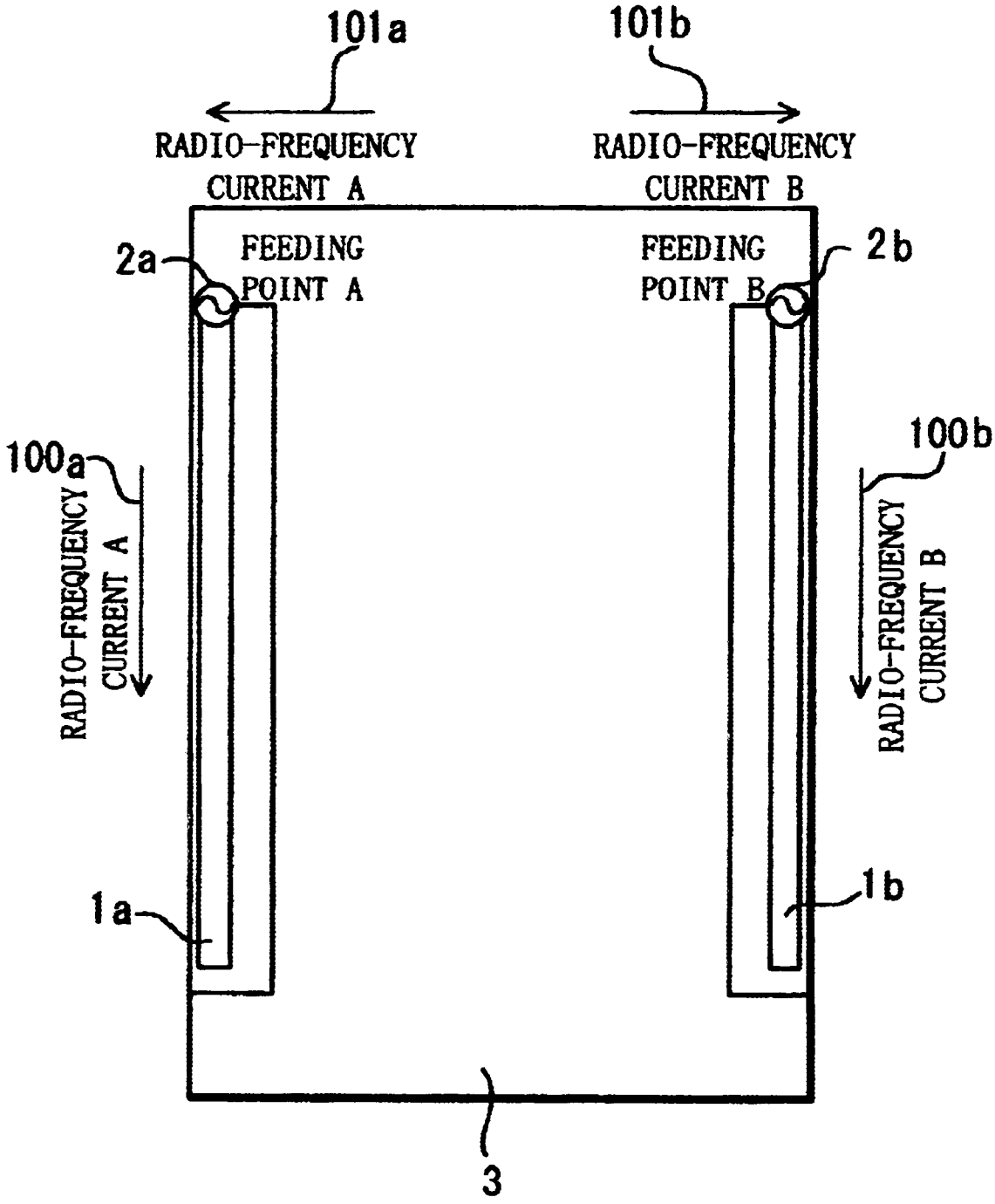
FIG. 1 shows an outline of the antenna structure according to Embodiment 1 of the present invention.

FIG. 1 shows the structure of an antenna according to Embodiment 1 of the present invention. FIG. 1 is a planar view of the antenna and the circuit board having the antenna mounted thereon. A first antenna (antenna element) 1*a* and a second antenna (antenna element) 1*b* are provided substantially parallel to each other at both ends of circuit board 3. At one end of first antenna 1*a* and second antenna 1*b*, respectively on the same side, feeding points (feeding portions) 2*a*, 2*b* are provided. Antenna 1*a*, 1*b* may be structured as a printed board layouts, a sheet metal, or a wire, etc.

According to the present device, antennas 1*a*, 1*b* are arranged symmetrically at both ends of circuit board 3, and are fed in equiphase. Feeding points 2*a*, 2*b* are desirably provided at the corner or in the vicinity of the corner of circuit board 3.

Furthermore, as antennas 1*a*, 1*b* are provided on circuit board 3, the antenna can be arranged in the vicinity of the transmitting/receiving and other circuits. Moreover, arranging the antenna in the vicinity of the circuit components does not entail deteriorated antenna property, thereby ensuring good antenna property.

A both-sided board, or a multi-layered board with more than two layers, is used for circuit board 3; the transmitting/receiving and other circuits are formed at the remaining portion excluding antennas 1*a*, 1*b* at the ends; and a ground pattern is provided that is sufficient to operate as the ground plane for such antennas. This structure permits the components to be arranged freely between the two antennas 1*a*, 1*b*.

Antennas 1*a*, 1*b* at both ends of circuit board 3 are monopole antennas, fed in equiphase.

Figure 2A:
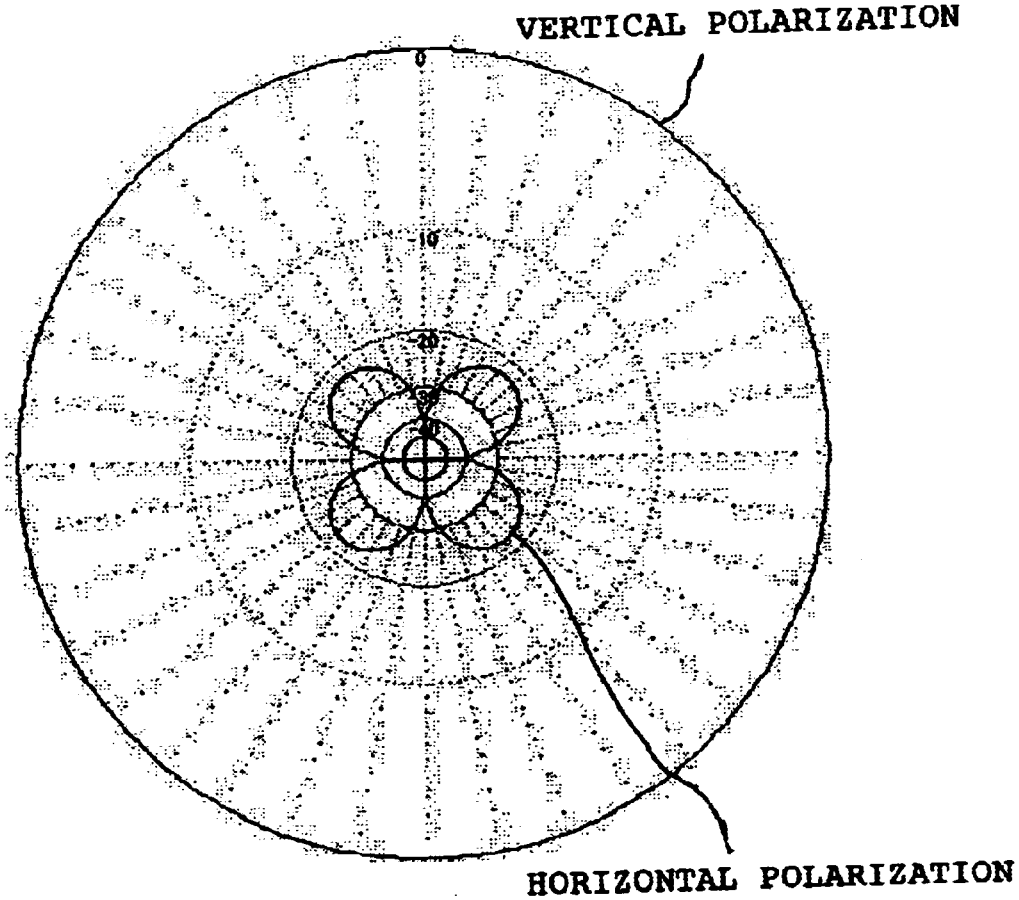
FIGS. 2A–2B show the/directional pattern when using the antennas on both sides.
Figure 2B:
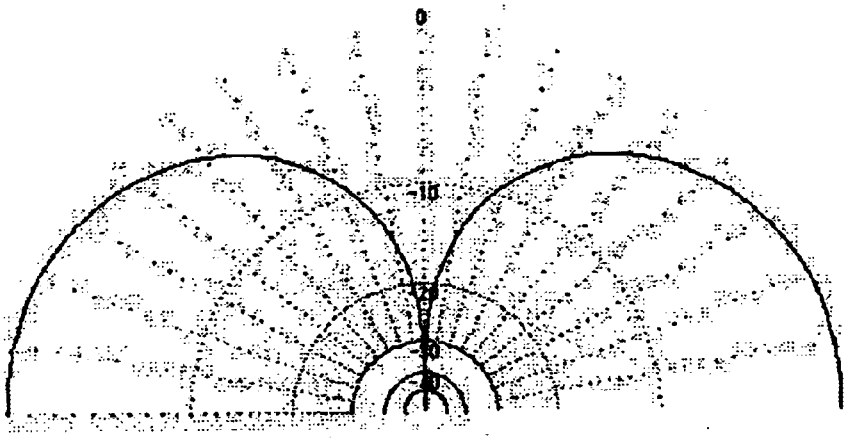

As the radio-frequency current flowing through antennas 1*a*, 1*b* is in equiphase, vertical polarization are radiated from the antennas. On the other hand, the radio-frequency current flowing horizontally in the ground plane portion is in antiphase, so horizontal polarization are not radiated. Therefore, only vertical polarization are efficiently radiated. By arranging the feeding points at the corners of the device, horizontal polarization can be effectively cancelled. Furthermore, as the antennas are provided at both sides, the device can be made non-directional. FIG. 2(*a*) shows the horizontal pattern of the antenna according to the present invention, and FIG. 2(*b*) shows the vertical pattern.

The length of antennas 1*a*, 1*b* is roughly one-fourth of the wavelength. The distance between antennas 1*a*, 1*b* is short compared to the wavelength, for example one-eighth of the wavelength or shorter. If the frequency used is 900 MHz, the size of the antenna according to the present invention inclusive circuit board 3 would be about the size of a business card.

Variation 1 of Embodiment 1

Figure 3A:
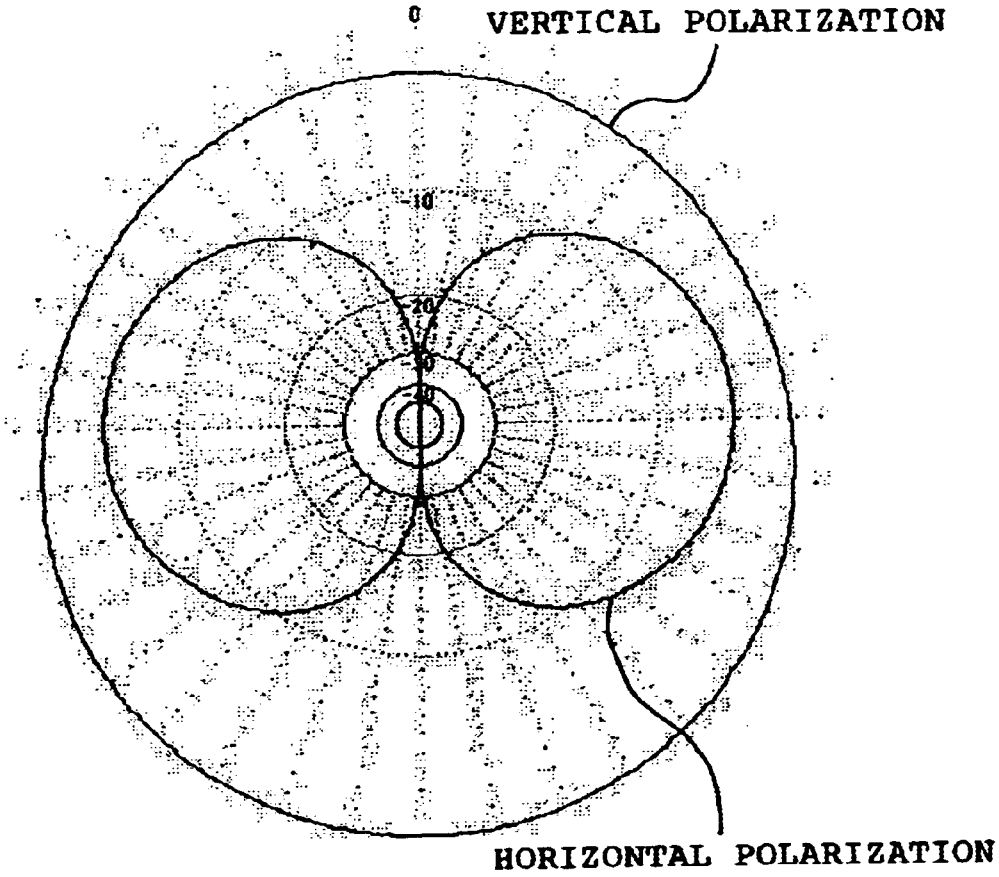
FIGS. 3A–3B show the directional pattern when using the antenna on one side.
Figure 3B:
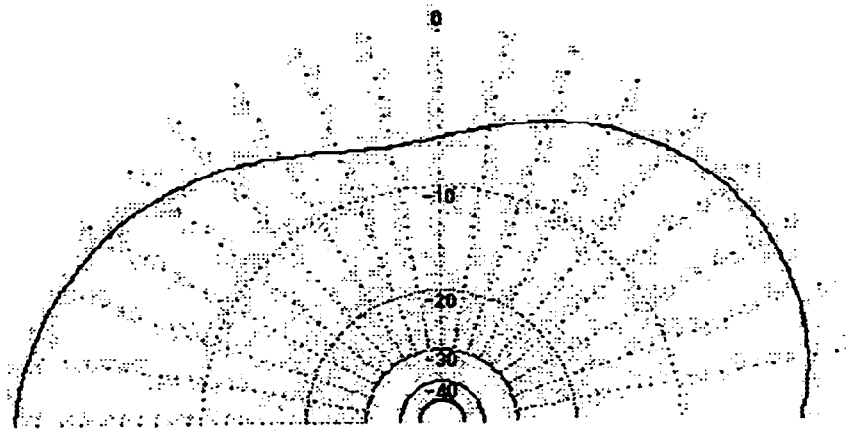

If the antenna is mounted only at one end, or only the antenna at one end is used, the ground plane becomes a reflector, causing directivity. FIG. 3(*a*) shows the horizontal pattern of the antenna according to the present invention, and FIG. 3(*b*) shows the vertical pattern.

By utilizing the characteristic that the antenna on one side has directivity, it is possible to provide directivity diversity by switching between the two antennas as may be suitable. In other words, a switching portion that selectively feeds antenna 1*a* or 1*b* is provided, and the preferred antenna in each situation can be used.

Embodiment 2

Figure 4:
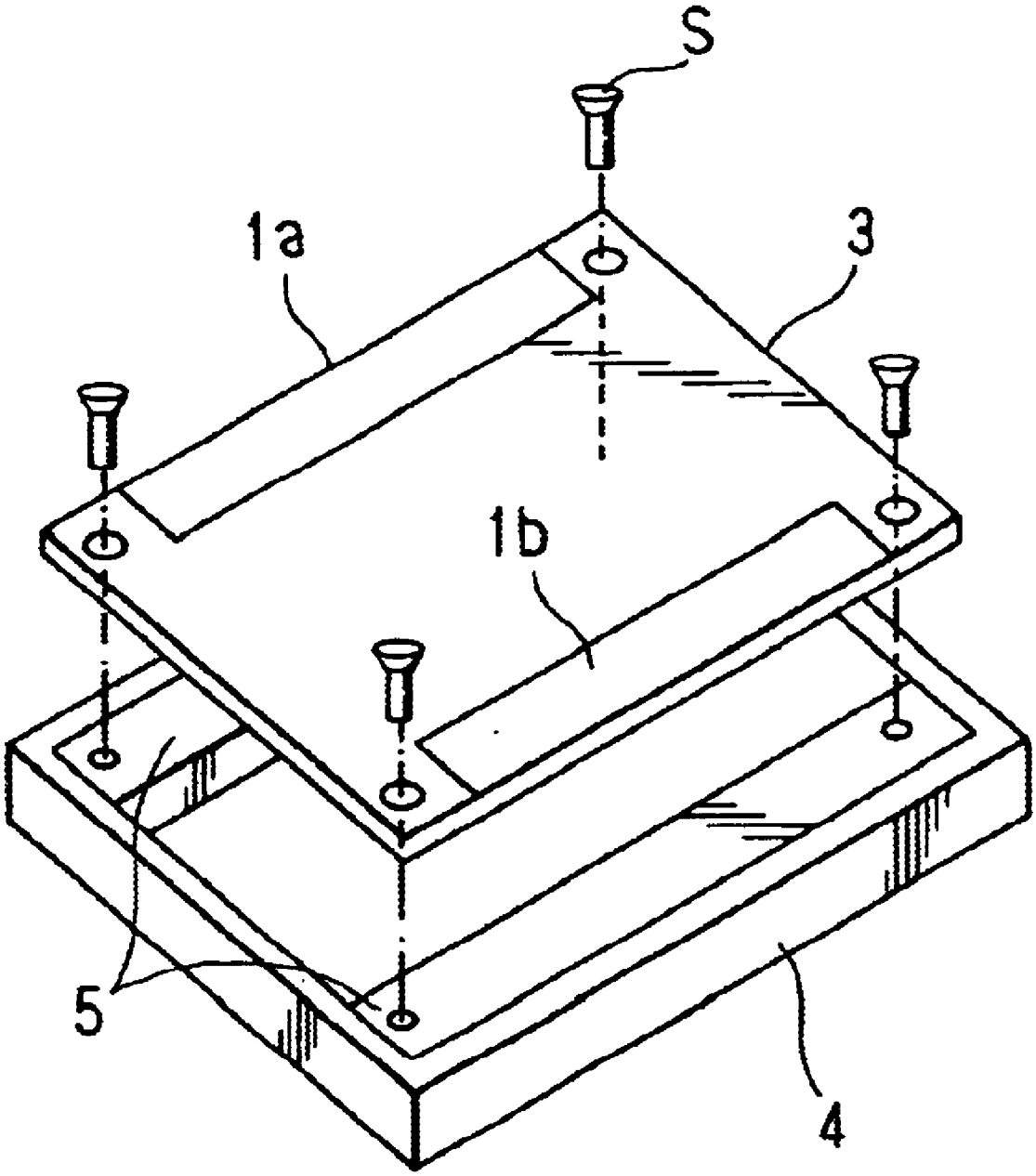
FIG. 4 shows an outline of the antenna structure according to Embodiment 2 of the present invention.

FIG. 4 shows how antennas 1*a*, 1*b* according to the present invention at both ends are structured by printed board layouts. In FIG. 4, portion 4 denotes the housing for circuit board 3, and portion 5 is the contact portion between the housing and circuit board 3 mounted within housing 5. Circuit board 3 is mounted at contact portion 5 by a screw S with the board in housing 4.

When antennas 1*a*, 1*b* are used as the contact portion between circuit board 3 and housing 4, housing 4 is made of a non-conductive dielectric, and the antennas are designed in consideration of the permittivity thereof. In such case, it is possible to provide sufficient mechanical strength because the printed board can be fixed to the housing at both ends.

By structuring antennas 1*a*, 1*b* as printed board layouts as shown in FIG. 4, the following effects can be achieved:

(1) Reduced number of components, reduced manufacturing steps, and compact-sized device; and (2) Mechanical strength and compact-sized device by structuring the antenna portion as the contact portion between the housing and the printed board.

Furthermore, housing 4 and circuit board 3 may be fixed by a screw, or the board may be clamped between housing 4. When mounting them with screw S, a conductive screw can be used if the screw is mounted on the ground plane portion excluding the antennas.

Embodiment 3

As the antennas are structured near the ground plane, the impedance is low, but the impedance can be raised by the following method.

OPERATIVE EXAMPLE 1

Folded Antenna

Figure 5:
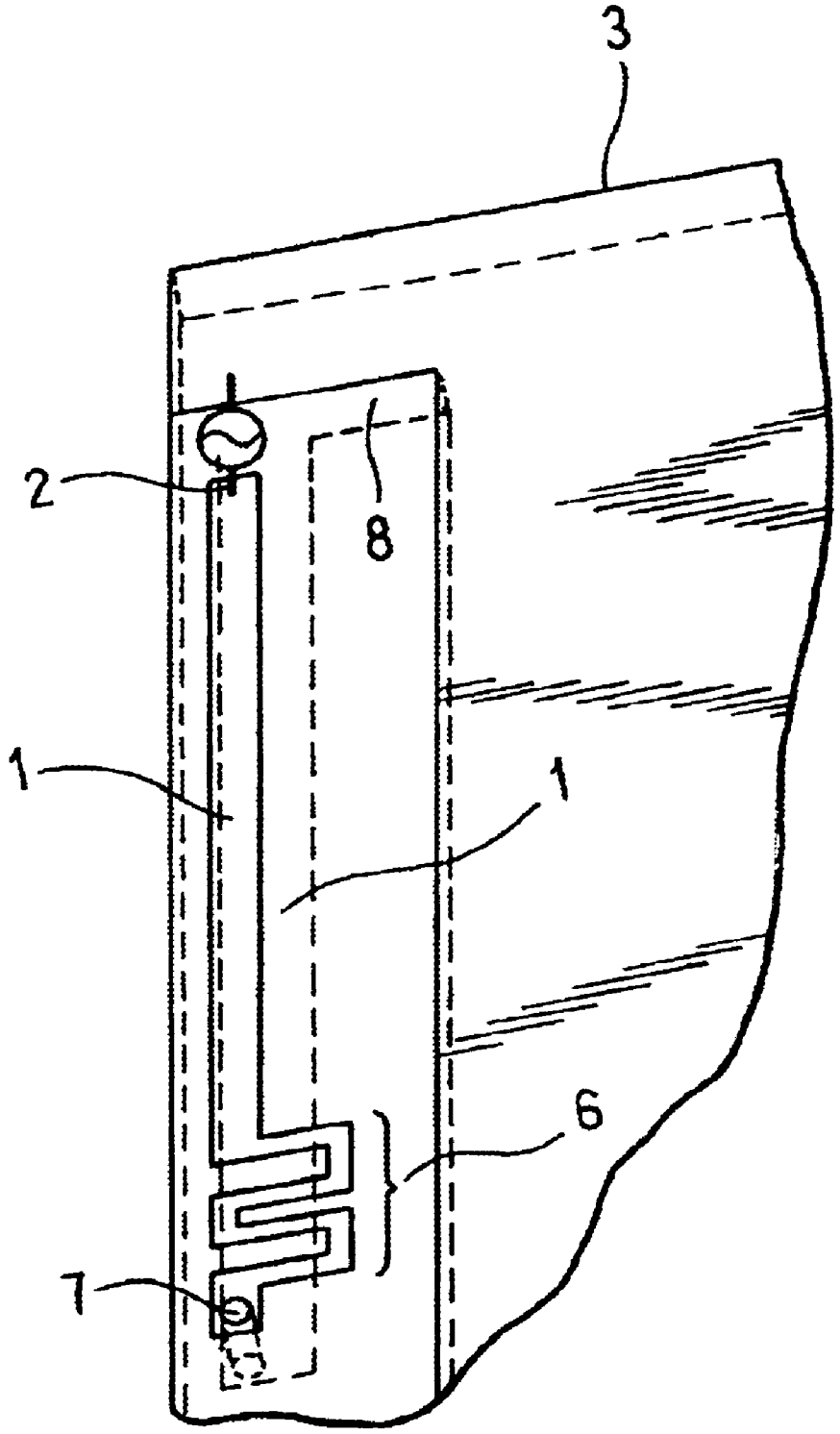
FIG. 5 shows an outline of the antenna structure according to Embodiment 3 of the present invention.

FIG. 5 shows a folded antenna according to Embodiment 3 of the present invention. In FIG. 5, portion 6 is a portion for adjusting the resonance frequency. The curved portion thereof functions to adjust the resonance frequency. Portion 7 is a through hole for connecting the surface layouts with the back layouts, and portion 8 is the ground plane on the back side. In FIG. 5, the surface layouts of circuit board 3 is denoted by solid lines, and the back layouts is denoted by dotted lines.

As shown in FIG. 5, printed antenna elements 1, 1 are provided on both sides of circuit board 3, the back side of the feeding point is connected to ground plane 8, and the tips of antenna elements 1, 1 on both sides are connected by through hole 7, thereby forming the folded antenna. Using a folded antenna raises the impedance. The impedance can be adjusted by using the width ratio of antenna elements 1, 1 on both sides.

Furthermore, the one side of the folded antenna, or the whole antenna may be formed by sheet metal.

OPERATIVE EXAMPLE 2

Method of Feeding Two Antennas

Figure 6:
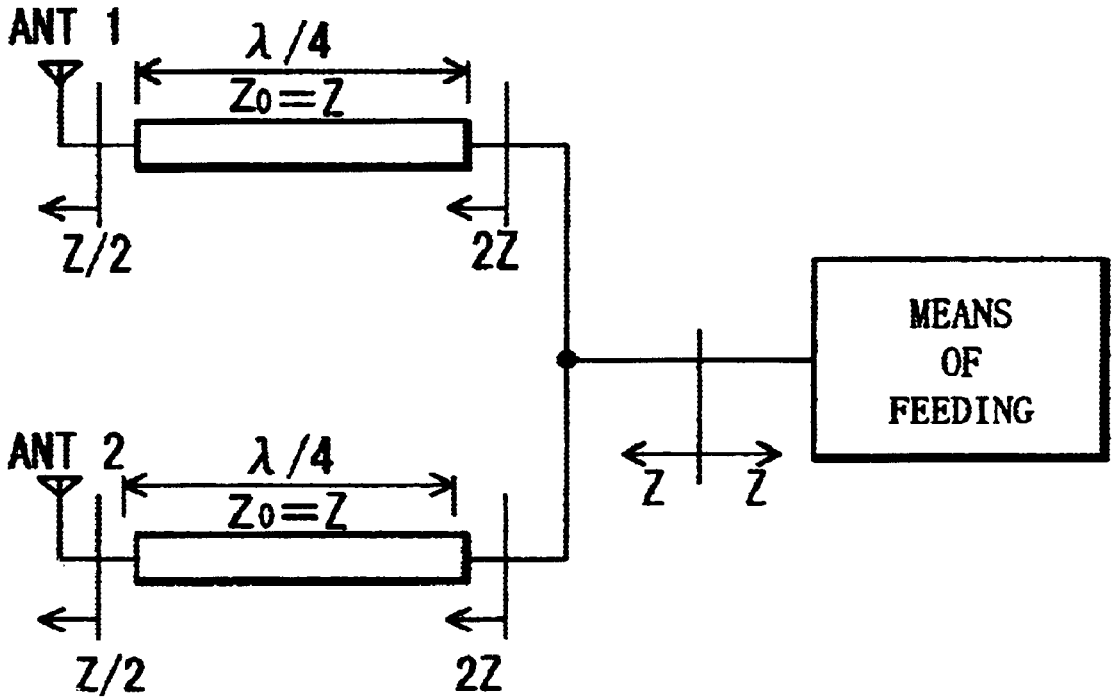
FIG. 6 shows an outline of another antenna structure according to Embodiment 3 of the present invention.

As shown in FIG. 6, the impedance can be raised by setting the length of the feeding line from each antenna feeding point to the transmitting/receiving unit to one-fourth of the wavelength $\lambda$. By setting the impedance at the antenna feeding points to half of the input/output impedance Z at the transmitting/receiving unit, the impedance becomes 2Z after the $\lambda/4$ feeding line, and thus, by connecting the two antenna feeding lines in parallel, they can be matched to the impedance Z of the transmitting/receiving unit.

The present invention is not limited to the above embodiments; variations are possible within the scope of the claims, which are incorporated in the scope of the present invention.

According to the present invention, antennas are provided symmetrically at both ends of the printed board and are fed in equiphase, thereby allowing circuit components and the like to be arranged in the vicinity of the antenna without deteriorated antenna property, making the whole device very compact. Also, an efficient antenna can be provided that radiates vertical polarization without directivity.

Furthermore, by forming the antenna with the layouts of the printed board, the number of components can be reduced, thereby achieving compact size, reduced manufacturing steps, less defects, and stable performance.

Also, by sharing the contact portion between the housing and the printed board with the antenna, the device can be made compact. As this allows a wide contact portion between the housing and the printed board at both ends of the board, mechanical strength is enhanced. Moreover, impedance matching and resonance frequency adjustment is uncomplicated

What is claimed is:

1. An antenna for a radio device, comprising:

a circuit board arranged within a radio device body;

a first radiating element and a second radiating element arranged in axial symmetry to each other on said circuit board; and a single feeding point provided on each of said first radiating element and said second radiating element, respectively for feeding in equiphase, wherein said first radiating element and said second radiating element are respectively provided at the ends of said circuit board, the feeding points of said first radiating element and said second radiating element are respectively provided in the vicinity of the corners of said circuit board, and said first radiating element and said second radiating element are both set to the same frequency.

2. An antenna for a radio device according to claim 1, wherein said first radiating element and said second radiating element are shaped substantially in a straight line, and are mounted substantially parallel to each other.

3. An antenna for a radio device according to claim 1, wherein a ground pattern sufficiently functioning as the ground plane for said first radiating element and said second radiating element is provided on said circuit board.

4. An antenna for a radio device according to claim 1, further comprising a switching portion for selectively feeding either said first radiating element or said second radiating element.

5. An antenna for a radio device according to claim 1, wherein said first radiating element and said second radiating element are formed by a sheet metal on said circuit board, and, when said circuit board is mounted within a housing, said circuit board is in surface contact with a mounting portion inside said housing at the back face of at least one of said first radiating element and said second radiating element.

6. An antenna for a radio device according to claim 1, wherein at least one of said first radiating element and said second radiating element includes:

a first portion provided on one face of said circuit board;

a second portion provided on the other face of said circuit board; and a connecting portion provided on the end of the side other than said feeding point for connecting said first portion with said second portion, wherein the other end of said second portion is a grounded, folded antenna.

7. An antenna for a radio device according to claim 1, wherein quarter-wave lines are provided between the feeding point of said first radiating element and a transmitting/receiving circuit and between the feeding point of said second radiating element and the transmitting/receiving circuit, respectively.

* * * * *